US009989883B2

(12) United States Patent
Okuda et al.

(10) Patent No.: US 9,989,883 B2
(45) Date of Patent: Jun. 5, 2018

(54) DEVELOPING APPARATUS, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Mitsuru Okuda, Suntou-gun (JP); Ryo Sugiyama, Mishima (JP); Yoshinobu Ogawa, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/649,706

(22) Filed: Jul. 14, 2017

(65) Prior Publication Data

US 2018/0031998 A1 Feb. 1, 2018

(30) Foreign Application Priority Data

Jul. 29, 2016 (JP) ..... 2016-150120

(51) Int. Cl.
*G03G 15/08* (2006.01)

(52) U.S. Cl.
CPC ..... *G03G 15/0812* (2013.01); *G03G 15/0817* (2013.01); *G03G 15/0818* (2013.01);
(Continued)

(58) Field of Classification Search
CPC ..... G03G 15/0817; G03G 2215/0861
See application file for complete search history.

(56) References Cited

U.S. PATENT DOCUMENTS 8,909,110 B2 12/2014 Nishida
2007/0297834 A1* 12/2007 Nishida ..... G03G 15/0812 399/284
2012/0301189 A1* 11/2012 Kase ..... G03G 15/0812 399/284

FOREIGN PATENT DOCUMENTS

JP 11-316499 A 11/1999
JP 2009-042320 A 2/2009
(Continued)

OTHER PUBLICATIONS

Takaaki Shinkawa et al., U.S. Appl. No. 15/658,621, filed Jul. 25, 2017.
(Continued)

*Primary Examiner* — Victor Verbitsky
(74) *Attorney, Agent, or Firm* — Fitzpatrick, Cella, Harper & Scinto

(57) ABSTRACT

The developing apparatus includes a developer carrying roller rotatable in a first rotating direction, and a developer regulating member which regulates a thickness of a developer layer carried on the developer carrying roller, wherein at least a part of the developer regulating member is in pressure contact with a surface of the developer carrying roller to form an abutting portion between the developer carrying roller and the developer regulating member, the abutting portion having an abutting width W in a circumferential direction of the developer carrying member of 1.0 to 5.0 mm, wherein in the abutting portion, an abutting pressure has a maximum value in a first area, the first area having a width of 20% or less of the abutting width W from an upstream edge of the abutting portion in the rotating direction, and wherein an abutting pressure in a second area is 0.08 to 0.18 MPa.

8 Claims, 6 Drawing Sheets

(52) U.S. Cl.
CPC ..... *G03G 2215/0861* (2013.01); *G03G 2215/0872* (2013.01)

(56) References Cited

FOREIGN PATENT DOCUMENTS

| | | | |
|---|---|---|---|
| JP | 2013-190643 | A | 9/2013 |
| JP | 2013-250333 | A | 12/2013 |
| JP | 2015-172728 | A | 10/2015 |

OTHER PUBLICATIONS

Yoshinobu Ogawa et al., U.S. Appl. No. 15/658,607, filed Jul. 25, 2017.

* cited by examiner

DEVELOPING APPARATUS, PROCESS CARTRIDGE AND ELECTROPHOTOGRAPHIC IMAGE FORMING APPARATUS

BACKGROUND OF THE INVENTION

Field of the Invention

The present invention relates to developing apparatuses and process cartridges included in electrophotographic image forming apparatuses, and electrophotographic image forming apparatuses.

Description of the Related Art

Widely known electrophotographic image forming apparatuses include developing apparatuses each including a developer carrier and a developer regulating member. The developer regulating member abuts on the developer carrier in a developer layer thickness regulating portion to form a thin layer of a developer, and perform frictional charge (tribomatic charging) on the developer.

Japanese Patent Application Laid-Open No. 2009-42320 discloses a developing apparatus including a developer regulating member including an elastic member having a surface facing a developer carrier and including an upstream surface portion and a downstream surface portion, wherein the upstream surface portion and the surface of the developer carrier form a developer intake gap, and the downstream surface portion has a concave curved surface having a curvature radius identical to the curvature radius of the surface of the developer carrier. According to the disclosure, this developer regulating member performs predetermined frictional charging without obstructing the transportation of the developer and increasing the abutting pressure to the developer carrier. Unfortunately, the developer regulating member has an insufficient force to regulate the developer. Such an insufficient force may lead to insufficient regulation for formation of a thin layer of the developer, and thus fails to transport a uniform amount of the developer in some cases. As a result, image defects caused by such insufficient regulation of the developer may be generated.

Japanese Patent Application Laid-Open No. H11-316499 discloses a developing apparatus including a developer regulating member contacting with a developer carrier with two or more contact points, and having a shape and a dimension identical to those of the outer periphery of the developer carrier. According to this disclosure, this developer regulating member can disperse the abutting pressure applied to the developer carrier to reduce the peak pressure of the developer carrier, increasing the allowance of generation of stripes caused by lacking of the developer. Unfortunately, if the abutting pressure is dispersed in the developer layer thickness regulating portion, use of small particle size developers fails to regulate the developers, generating image defects due to such insufficient regulation of the developers.

The image defects are caused by failing to regulate the thickness of the developer layer on the developer carrier during application of a predetermined charge to the developer. An insufficient regulating force to the developer on the developer carrier results in the formation of a thick developer layer on the developer carrier rather than the formation of a thin layer of the developer. Such an insufficient regulating force also prevents formation of a stable layer. As a result, the amount of the developer transported to the photosensitive member increases, generating scattering of the developer to undesired portions (fogging) and spill of the developer from the developer container (leakage of the developer). Furthermore, the developer in an amount more than a predetermined amount transported onto the developer carrier results in insufficient charging to the developer, so that a predetermined charge cannot be applied to the developer.

The present inventors, who have conducted extensive research, have found that the shape of the developer layer thickness regulating portion and the control of the pressure distribution in the developer layer thickness regulating portion are important for stable charging of the developer to form a thin layer of the developer on the developer carrier.

SUMMARY OF THE INVENTION

The present invention is directed to providing a developing apparatus which can sufficiently charge a developer and uniformly regulate a developer layer on a developer carrier to a predetermined thickness to prevent scattering of the developer and spill of the developer in and out of a developer container, thereby reducing fogging images.

According to one aspect of the present invention, there is provided a developing apparatus including a developer carrying roller rotatable in a first rotating direction, and a developer regulating member which regulates the thickness of a developer layer carried on the developer carrying roller, wherein at least a part of the developer regulating member is in pressure contact with a surface of the developer carrying roller to form an abutting portion between the developer carrying roller and the developer regulating member, the abutting portion having an abutting width W in a circumferential direction of the developer carrying member of 1.0 mm or more and 5.0 mm or less, wherein in the abutting portion, an abutting pressure has a maximum value in a first area, the first area having a width of 20% or less of the abutting width W from an upstream edge of the abutting portion in the rotating direction, and wherein an abutting pressure in a second area is 0.08 MPa or more and 0.18 MPa or less, the second area starting at a point in a downstream side in the rotating direction from the upstream edge of the abutting portion by 30% of the abutting width W, and ending at a point in a downstream side in the rotating direction from the upstream edge of the abutting portion by 90% of the abutting width W.

According to another aspect of the present invention, there is provided a process cartridge detachably attachable to a main body of an electrophotographic image forming apparatus, and including the developing apparatus. According to further another aspect of the present invention, there is provided an image forming apparatus including the developing apparatus.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

[Developing Apparatus]

The developing apparatus according to one aspect of the present invention includes a developer carrying roller rotatable in a first rotating direction, and a developer regulating member which regulates a thickness of a developer layer carried on the developer carrying roller, and at least a part of the developer regulating member is in pressure contact with a surface of the developer carrying roller to form an abutting portion between the developer carrying roller and the developer regulating member. The abutting portion has an abutting width W in a circumferential direction of the developer carrying member of 1.0 mm or more and 5.0 mm or less. In the abutting portion, an abutting pressure has a maximum value in a first area, and the first area has a width of 20% or less of the abutting width W from an upstream edge of the abutting portion in the rotating direction, i.e. the first area starts at the upstream edge of the abutting portion, and ends at a point in a downstream side in the rotating direction from the upstream edge of the abutting portion by 20% of the abutting width W. Further, an abutting pressure in a second area is 0.08 MPa or more and 0.18 MPa or less. The second area starts at a point in a downstream side in the rotating direction from the upstream edge of the abutting portion by 30% of the abutting width W, and ends at a point in a downstream side in the rotating direction from the upstream edge of the abutting portion by 90% of the abutting width W.

The term "abutting width W" in the circumferential direction of the developer carrying roller refers to the length of an arc of a surface of the developer carrying roller which is in pressure contact with the developer regulating member. The term "upstream edge of the abutting portion" between the developer carrying roller and the developer regulating member refers to the position of an edge located upstream in a first rotational direction of the developer carrying roller, for example, a rotational direction shown as an arrow "b" in FIG. 1 and FIG. 2, in a portion in which the developer regulating member abuts on the surface of the developer carrying roller, for example, a position corresponding to the point A in FIG. 2. The term "downstream edge of the abutting portion" refers to the position of an edge located downstream in the first rotational direction of the developer carrying roller in a portion in which the developer regulating member abuts on the surface of the developer carrying roller, for example, a position corresponding to the point B in FIG. 2.

Figure 2:
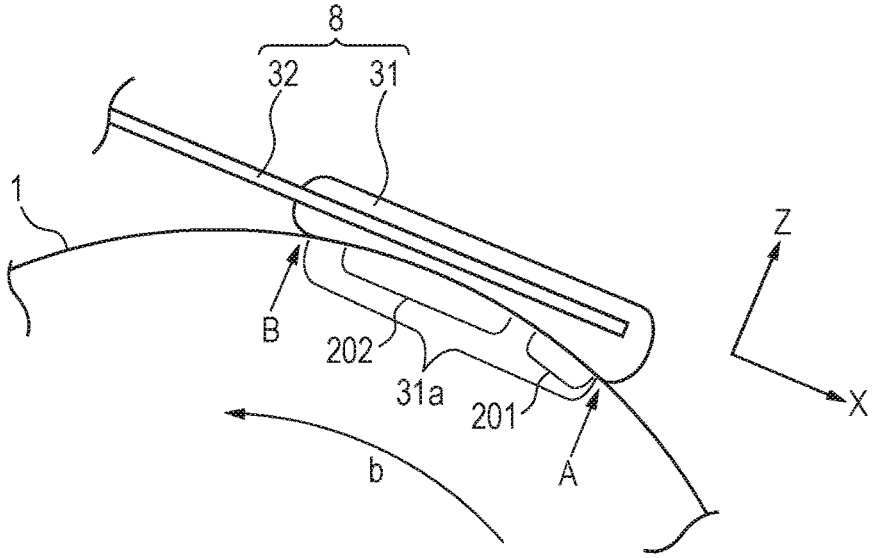
FIG. 2 is a schematic sectional view illustrating an example of the developer regulating member according to the present invention.

In the present invention, the term "longitudinal direction" refers to a direction parallel to the rotational axis of the developer carrying roller. In FIG. 2, the term "longitudinal direction" refers to a direction perpendicular to the paper. The term "lateral direction" refers to the X-direction in FIG. 2, and the term "thickness direction" refers to the Z-direction in FIG. 2.

[Developer Carrying Roller]

Figure 5:
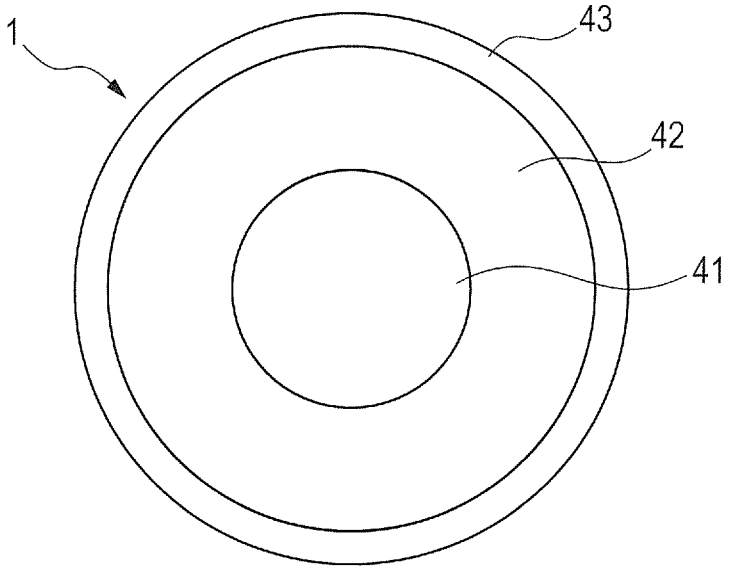
FIG. 5 is a schematic sectional view illustrating an example of the developer carrying roller according to the present invention.

For example, as illustrated in FIG. 5, the developer carrying roller includes a cylindrical or hollow cylindrical conductive substrate 41, a conductive elastic layer 42 disposed on the outer peripheral surface of the conductive substrate 41, and a surface layer 43 disposed on the outer peripheral surface of the conductive elastic layer. The developer carrying roller can have any configuration other than the above configuration. A known developer carrying roller can be used.

<Substrate>

The substrate has conductivity, and supports the conductive elastic layer disposed thereon. Examples of the materials for the substrate include metals, such as iron, copper, aluminum and nickel; and alloys containing these metals, such as stainless steel, duralumin, brass and bronze. To give scratch resistance, the surface of the substrate may be plated in the range not impairing the conductivity. Furthermore, resin substrates having conductive surfaces coated with metals, and those prepared from conductive resin compositions can also be used.

<Conductive Elastic Layer>

The conductive elastic layer is disposed to provide a developer carrying roller having the elasticity required for the apparatus including the developer carrying roller. The conductive elastic layer specifically may have either a solid body or a foamed body. The conductive elastic layer may include a single layer or a plurality of layers. The developer carrying roller is always pressed against to the photosensitive drum and the developer regulating member under pressure. To reduce damage of these members mutually given, a conductive elastic layer having low hardness and low compression set is disposed, for example.

Examples of the materials for the conductive elastic layer include natural rubber, isoprene rubber, styrene rubber, butyl rubber, butadiene rubber, fluorocarbon rubber, urethane rubber and silicone rubber. These may be used singly or in combinations of two or more.

The conductive elastic layer may contain conductive agents, non-conductive fillers, and a variety of additive components needed for molding such as crosslinking agents, catalysts and dispersion promoters according to the functions required for the developer carrying roller.

Examples of the conductive agents compounded in the conductive elastic layer include a variety of conductive metals or alloys, conductive metal oxides, fine particles of insulation substances coated with these conductive metal materials, electrically conductive agents such as carbon black, and ionically conductive agents. These conductive agents may be used singly or in combinations of two or more in the form of powder or fibers. Among these conductive agents, an electrically conductive agent carbon black can be used because of its high controllability of the conductivity and low cost.

Such a conductive agent can be contained to control the volume resistivity of the conductive elastic layer to be $1\times10^4$ to $1\times10^{10}$ Ω·cm. A developer carrying roller including a conductive elastic layer having a volume resistivity in this range facilitates the control of the amount of the toner to be developed on the photosensitive drum. The conductive elastic layer has a volume resistivity of more preferably $1\times10^4$ to $1\times10^9$ Ω·cm.

Examples of the non-conductive fillers optionally contained in the conductive elastic layer include: diatomite, quartz powder, dry silica, wet silica, titanium oxide, zinc oxide, aluminosilicic acid, calcium carbonate, zirconium silicate, aluminum silicate, talc, alumina and iron oxide.

The conductive elastic layer gives the elasticity required for the developer carrying roller. The conductive elastic layer can have an asker C hardness of 10 degrees or more and 80 degrees or less, for example. A conductive elastic layer having an asker C hardness of 10 degrees or more can reduce the compression set caused by each member disposed facing the developer carrying roller. A conductive elastic layer having an asker C hardness of 80 degrees or less can decrease the stress applied to the developer, and can suppress a reduction in image quality caused by repeated formation of images. Herein, the asker C hardness can be specified by the value measured by an asker rubber durometer (manufactured by Kobunshi Keiki Co., Ltd.).

The conductive elastic layer has a thickness of preferably 0.1 mm or more and 50 mm or less, more preferably 0.5 mm or more and 10 mm or less.

Examples of the method of molding the conductive elastic layer include a variety of molding methods such as extrusion molding, press molding, injection molding, liquid injection molding and mold injection molding in which the material is cured by heating at an appropriate temperature for an appropriate time to mold a conductive elastic layer over a substrate. In mold injection molding, an uncured material for a conductive elastic layer is injected into a cylindrical metal mold in which a substrate is disposed, and is cured by heating. Such a method enables the molding of the conductive elastic layer around the substrate with precision.

<Surface Layer>

The developer carrying roller may have a layer such as a surface layer on the outer periphery of the conductive elastic layer to have properties needed for the developer carrying roller which transports or charges the developer. The surface layer can be a resin layer to satisfy these properties. Examples of the resin forming the surface layer include fluorinated resins, polyamide resins, melamine resins, silicone resins, urethane resins and mixtures thereof.

The surface layer in use may contain a resin and carbon black, which gives conductivity and reinforcing properties to the surface layer. The amount of carbon black to be compounded can be 3% by mass or more and 30% by mass or less relative to the resin component. The surface layer can be formed as follows: the resin is mixed with carbon black and a solvent, and is dispersed to prepare a coating solution, and the coating solution is applied onto a conductive elastic layer. Any solvent which can dissolve the resin to be used for the surface layer can be used for the coating solution.

The surface layer can have a thickness of 4 μm or more and 50 μm or less. A surface layer having a thickness of 4 μm or more can reduce wear during use. A surface layer having a thickness of 50 μm or less can decrease the stress applied to the developer caused by the surface hardness of the developer carrying roller.

The surface layer can have any surface roughness. The surface roughness of the surface layer can be appropriately adjusted in use to ensure the force to transport the developer and thus obtain images of high quality. An effective method of controlling the surface roughness is that a particle having a desired particle size is contained in the surface layer. The particle used in the surface layer may be a metal particle and a resin particle having a particle size of 0.1 μm or more and 30.0 μm or less. Among these particles, a resin particle is more preferred because of their high flexibility, relatively low specific gravity, and the readily attainable stability of the coating material. If the surface layer includes multiple sublayers, such a particle may be contained in all of the multiple sublayers, or may be contained in at least one layer of these sublayers.

[Developer Regulating Member]

An example of the developer regulating member according to one aspect of the present invention is illustrated in FIG. 2. FIG. 2 illustrates the state where the developer regulating member abuts on the surface of the developer carrying roller. The developer regulating member includes at least a supporting member 32 and a blade member 31. The supporting member and the blade member may be formed of a single material, or may be formed of different materials. Any supporting member which can support the blade member can be used in the developer regulating member. In the present invention, the supporting member and the blade member are not limited to the form of the both being present as individual members separated from each other, and may be in a form in which the both are integrated to be present as a support portion and a blade portion of the developer regulating member.

[Supporting Member]

Any material can be used in the supporting member. Examples of the material include metals such as surface treated steel sheet, stainless steel, phosphor bronze and aluminum; and resins such as acrylic resins, polyethylene resins and polyester resins. If these resins require conductivity in use, a conductive material can be added to the resins.

The supporting member can have any thickness (distance in the Z-direction in FIG. 2). The thickness can be 0.05 mm or more and 3 mm or less. In particular, because a supporting member in the form of a thin plate having a thickness of 0.05 mm or more and 0.15 mm or less has appropriate spring properties, the blade member can be brought into abutment with the developer carrying roller at an appropriate abutting pressure to regulate the developer on the developer carrying roller to an appropriate layer thickness. A supporting member having a thickness of 0.8 mm or more facilitates attachment and positioning of the developer regulating member to the developing apparatus, the process cartridge and the image forming apparatus without distortion. Thus, the blade member can be stably brought into abutment with the developer carrying roller at an appropriate abutting pressure.

If the supporting member and the blade member are formed of a single metal material, the supporting member can be molded by a method such as bending such as pressing, electrochemical machining, electrical discharge machining, or laser beam machining.

A supporting member formed of a thermoplastic resin can be molded by extrusion molding or injection molding, for example. Specifically, in extrusion molding, the thermoplastic resin melted by heating can be injected into a metal mold to mold the resin into a supporting member. In injection molding, the thermoplastic resin can be injected into a metal molding cavity, and be cooled to be molded into a supporting member.

[Blade Member]

Any material can be used in the blade member. Examples of the material include elastic materials such as rubber and thermoplastic elastomers, and a variety of resins. Specific examples thereof include: rubbers having rubber elasticity such as thermosetting polyurethane rubber, silicone rubber and liquid rubber; thermoplastic resins such as polyester resins, polyamide resins and polyether resins; and thermoplastic elastomers such as polyester elastomers, polyurethane elastomers and polyamide elastomers.

If the blade member is formed of a different material from that for the supporting member, the following materials can be used in the blade member: thermosetting resins or rubbers such as silicone resins, silicone rubbers, urethane resins, urethane rubbers, phenol resins, urea resins, melamine resins, acrylic resins and epoxy resins; and thermoplastic resins such as acrylic resins, polyethylene resins, polyamide resins, polyester resins and polyether resins. Among these materials, the thermoplastic resins can be used in molding of the blade member because these resins can be readily deformed into desired shapes.

If the material for the supporting member is different from that for the blade member, the blade member can have any thickness (distance in the Z-direction in FIG. 2). The thickness of the developer layer thickness regulating portion can be 10 μm or more and 3 mm or less. In the developer layer thickness regulating portion, a blade member having a thickness of 10 μm or more can ensure the durability against abrasion caused by friction with the developer carrier while maintaining the elasticity as a resin or a rubber. In the developer layer thickness regulating portion, a blade member having a thickness of 3 mm or less with the developer carrying roller can provide a stable abutting pressure.

The blade member may be formed in any place of the supporting member. The blade member may be formed on one surface of the supporting member abutting on the developer carrying roller. The blade member may be formed into a shape so as to cover both surfaces of the supporting member. Specifically, as illustrated in FIG. 2, for example, the blade member may be formed at one end of the supporting member so as to cover both surfaces of the developer layer thickness regulating portion.

The blade member may be formed by a method such as metal mold molding, extrusion molding, coating molding, molding by bonding sheets, or injection molding. Specifically, in mold molding or extrusion molding, molding can be performed as follows: a supporting member coated with an adhesive when necessary is disposed in a metal mold, and a resin material melted by heating is injected into the metal mold to be molded into a blade member joined to the supporting member. In molding by bonding sheets, a blade member molded in the form of a sheet by extrusion molding can be bonded to a supporting member coated with an adhesive. In injection molding, the resin material can be injected into a metal molding cavity, and be cooled to be molded into a blade member.

The blade member includes a developer layer thickness regulating portion abutting on the developer carrying roller. The developer layer thickness regulating portion can have a concave curved surface relative to the surface of the developer carrying roller such that the abutting portion between the developer carrying roller and the developer regulating member has an abutting width W of 1.0 mm or more and 5.0 mm or less in the circumferential direction of the developer carrying roller. A developer layer thickness regulating portion having a concave curved surface can ensure a long abutting width. Examples of the shape of the blade member in the developer layer thickness regulating portion specifically include arc shapes, and arc shapes having a projected upstream edge of the abutting portion (FIG. 4D). More preferred is an arc shape of a circle concentric with a cross-sectional circle of the developer carrying roller.

In the formation of the blade member, an adhesive layer may be formed on the supporting member when necessary. Examples of the material for the adhesive layer include hot-melt adhesives such as polyurethane adhesives, polyester adhesives, ethylene vinyl alcohol (EVA) adhesives and polyamide adhesives.

[Conductive Agent]

The supporting member, the blade member and the adhesive layer may contain a conductive agent when necessary. Examples of the conductive agent include ionically conductive agents and electronically conductive agents such as carbon black.

Examples of carbon black specifically include conductive carbon black such as "Ketjenblack" (trade name, manufactured by Lion Corporation) and acetylene black; and carbon black for rubber such as SAF, ISAF, HAF, FEF, GPF, SRF, FT and MT. Besides, carbon black for color ink subjected to an oxidation treatment, and pyrolysis carbon black can be used. Carbon black can be used in an amount of 5 parts by mass or more and 50 parts by mass or less relative to 100 parts by mass of the resin or rubber. The content of carbon black in the resin or rubber can be measured with a thermogravimetric analyzer (TGA).

In addition to carbon black above, examples of usable electronically conductive agents include: graphites such as natural graphite and artificial graphites; powdery metals such as copper, nickel, iron and aluminum; powdery metal oxides such as titanium oxide, zinc oxide and tin oxide; and conductive polymers such as polyaniline, polypyrrole and polyacetylene. These conductive agents can be used singly or in combinations of two or more when necessary.

Examples of the ionically conductive agent include: perchlorates, chlorates, hydrochlorides, bromates, iodates, fluoroboric acid salts, trifluoromethylsulfates, sulfonates and bis(trifluoromethylsulfonic acid)imide salts containing ammonium ions such as tetraethylammonium, tetrabutylammonium, lauryltrimethylammonium, dodecyltrimethylammonium, stearyltrimethylammonium, octadecyltrimethylammonium, hexadecyltrimethylammonium, benzyltrimethylammonium and modified aliphatic dimethylethylammonium; perchlorates, chlorates, hydrochlorides, bromates, iodates, fluoroboric acid salts, trifluoromethyl sulfates, sulfonates and bis(trifluoromethylsulfonic acid)imide salts containing an alkali metal or an alkaline earth metal such as lithium, sodium, calcium or magnesium. Among these, trifluoromethyl sulfates and bis(trifluoromethyl sulfonic acid)imide salts of an alkali metal or ammonium ion can be used. These salts are suitable because these have a structure of an anion containing fluorine, and thus have a large effect of giving conductivity. These salts can be used singly or in combinations of two or more when necessary.

The supporting member, the blade member and the adhesive layer may contain other additives such as a charge control agent, a lubricant, a filler, an antioxidant and an anti-aging agent in the range not inhibiting the functions of the resin or rubber, and the conductive agent.

[Developing Apparatus]

In the developing apparatus according to one aspect of the present invention, the abutting portion between the developer carrying roller and the developer regulating member has an abutting width W of 1.0 mm or more and 5.0 mm or less in the circumferential direction of the developer carrying roller, and the abutting portion has a maximum value of an abutting pressure in a region from an upstream edge of the abutting portion to 20% or less of the abutting width W, and has an abutting pressure of 0.08 MPa or more and 0.18 MPa or less in a region from the upstream edge to 30 to 90% of the abutting width W.

Figure 1:
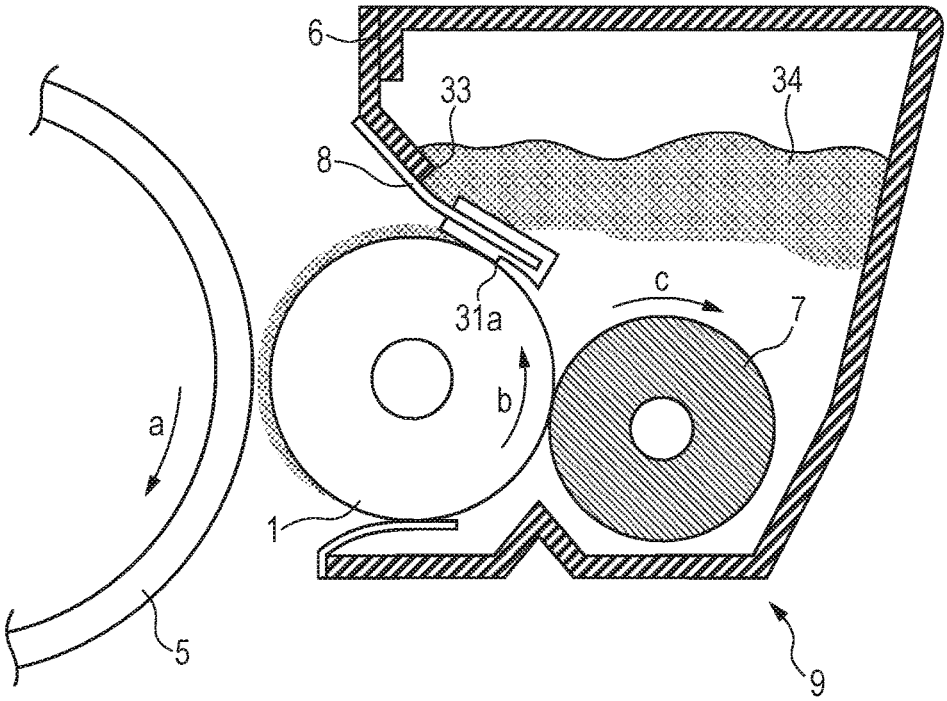
FIG. 1 is a schematic sectional view illustrating an example of the developing apparatus according to the present invention.

An example of the developing apparatus according to one aspect of the present invention is illustrated in FIG. 1. This developing apparatus 9 includes a developer container 6 which accommodates a developer 34, a developer carrying roller 1 which transports the developer 34, and a developer regulating member 8 which regulates the developer 34 on the surface of the developer carrying roller. The developing apparatus may include a developer feed roller 7 when necessary.

The abutting width W of the abutting portion and the pressure distribution of the abutting pressure are controlled by the shape of the developer layer thickness regulating portion of the developer regulating member and the way of abutment of the developer layer thickness regulating portion on the surface of the developer carrying roller. Non-limiting examples thereof are illustrated in FIG. 4A, FIG. 4B, FIG. 4C and FIG. 4D.

Figure 4A:
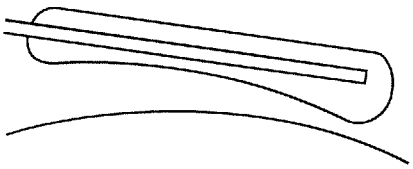
FIGS. 4A, 4B, 4C and 4D are schematic sectional views illustrating an example of a positional relation between the shape of a developer layer thickness regulating portion of the developer regulating member according to the present invention and the surface of a developer carrying roller.

FIG. 4A: A developer layer thickness regulating portion having an arc shape identical to the arc shape of a cross-sectional circle of the developer carrying roller is tilted in the state that the distal end of the developer regulating member is closer to the surface of the developer carrying roller, and is pressed against the surface of the developer carrying roller.

Figure 4B:
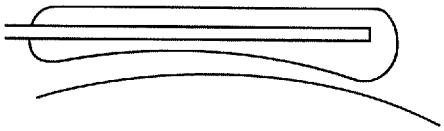

FIG. 4B: A developer layer thickness regulating portion having an arc shape identical to the arc shape of a cross-sectional circle of the developer carrying roller is pressed against the surface of the developer carrying roller in the state that the center of the cross-sectional circle of the developer carrying roller is deviated from the center of the arc of the developer layer thickness regulating portion.

Figure 4C:
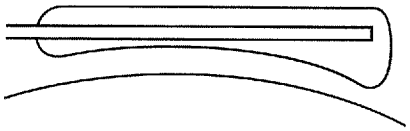
Figure 4D:
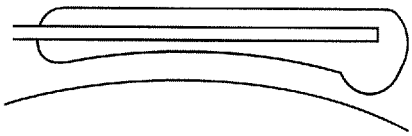

FIG. 4C: A developer layer thickness regulating portion having an arc shape identical to the arc shape of a cross-sectional circle of the developer carrying roller and a distal end having an arc shape having a curvature radius smaller than that of the arc shape of the circle is pressed against the surface of the developer carrying roller.

FIG. 4D: A developer layer thickness regulating portion having an arc shape identical to the arc shape of a cross-sectional circle of the developer carrying roller and a projected distal end is pressed against the surface of the developer carrying roller.

In the present invention, the term "distal end of the developer regulating member" refers to the end of the developer regulating member disposed on the side of the "upstream edge of the abutting portion."

[Abutting Width "W" ]

In the developing apparatus, the abutting portion between the developer carrying roller and the developer regulating member has an abutting width W of 1.0 mm or more and 5.0 mm or less in the circumferential direction of the developer carrying roller. The abutting width W is more preferably 1.0 mm or more and 2.0 mm or less. An abutting width W of less than 1.0 mm results in an excessively short frictional distance between the developer regulating member and the developer. Such an excessively short frictional distance results in insufficient charging of the developer, generating image defects such as fogging. An abutting width W of more than 5.0 mm results in an excessively long frictional distance between the developer regulating member and the developer to readily degrade the developer. As a result, the developer itself is unlikely to retain charges, generating image defects such as insufficient density of the developer.

[Maximum Value of Abutting Pressure]

In the developing apparatus, the abutting portion between the developer carrying roller and the developer regulating member has a maximum value of the abutting pressure in a first area. The first area starts at the upstream edge and ends at a point in a downstream side in the rotational direction from the upstream edge of the abutting portion by 20% or less of the abutting width W. That is, the first area is an upstream area having a width of 20% or less of the abutting width W from the upstream edge of the abutting portion. For example, in FIG. 2, the first area is shown as an area 201. The developer layer thickness regulating portion regulates the developer to have an appropriate layer thickness on the developer carrying roller in the upstream portion in which the developer starts abutment on the developer regulating member, and then gives appropriate charges to the developer through friction with the developer regulating member. The regulation of the thickness of the developer layer followed by the charging of the developer can result in appropriate charging of the developer with efficiency.

If a maximum value of the abutting pressure is present outside of the first area, i.e. an area from the upstream edge of the abutting portion by more than 20% of the abutting width W, an uncontrollable large amount of the developer will be disposed onto the developer carrying roller before the place in which the abutting pressure reaches the maximum value, thus generating insufficient regulation of the layer thickness of the developer. Such insufficient regulation of the layer thickness of the developer causes difficulties in appropriate charging of the developer within the range of the developer layer thickness regulating portion after the place in which the abutting pressure reaches the maximum value, thus generating image defects such as fogging.

Furthermore, the maximum value of the abutting pressure may preferably be 0.2 MPa or more and 1.0 MPa or less. A maximum value of the abutting pressure of 0.2 MPa or more facilitates appropriate regulation of the thickness of the developer layer on the developer carrying roller. A maximum value of the abutting pressure of 1.0 MPa or less can reduce the degradation of the developer, and prevent a developer having a small particle size from being preferentially held on the developer carrying roller. As a result, image defects such as fogging can be reduced.

[Abutting Pressure in a Second Area]

In the developing apparatus, the abutting portion has an abutting pressure of 0.08 MPa or more and 0.18 MPa or less in a second area, for example, shown as 202 in FIG. 2. The second area starts at a point in a downstream side in the rotating direction of the developer carrying roller from the upstream edge of the abutting portion by 30% of the abutting width W, and ends at a point in a downstream side in the rotating direction from the upstream edge of the abutting portion by 90% of the abutting width W. In the developing apparatus according to the present invention, the thickness of the developer layer is regulated by controlling the abutting pressures so as to reach the maximum value in the first area, and the developer is appropriately charged in the second area.

An abutting pressure of less than 0.08 MPa in the second area, readily unstabilizes the abutment between the developer regulating member and the developer carrying roller. For this reason, if the maximum value of the abutting pressure acts to regulate the thickness of the developer layer in the first area, the developer cannot be stably charged. As a result, the charge applied to the developer fluctuates, generating image defects such as fogging, low density of the developer, and unevenness of images called ghost. Moreover, if the abutting pressure is more than 0.18 MPa in the second area, high pressure is continuously applied to the developer in the developer layer thickness regulating portion in the downstream portion after the first area. For this reason, the developer readily degrades. As a result, the developer itself is unlikely to retain charges, generating image defects such as low density of the developer. The abutting pressure in a downstream area of the second area, i.e. an area beyond the second area, may preferably be lower than the abutting pressure in the second area.

[Process Cartridge]

Figure 6:
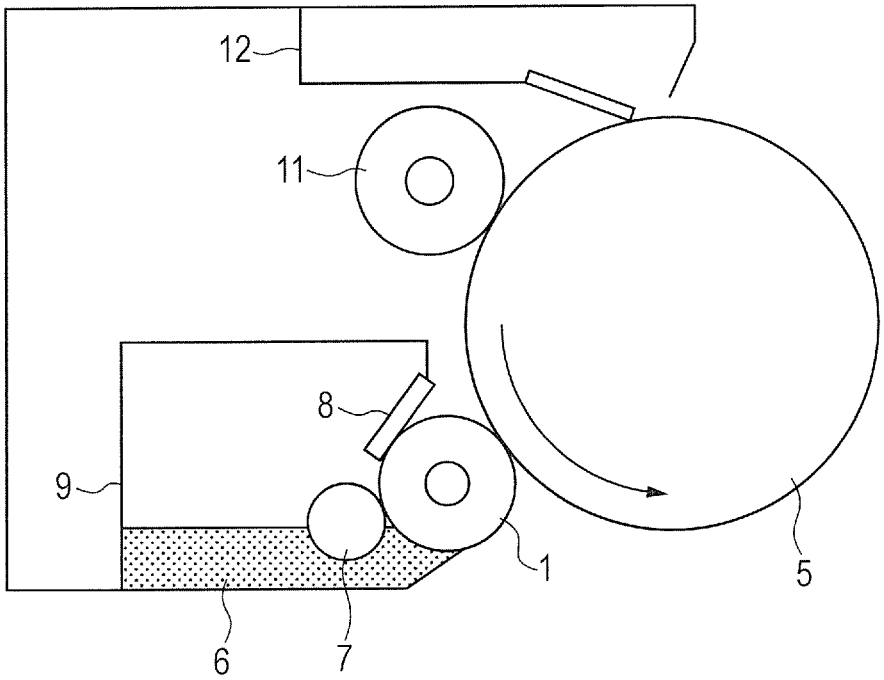
FIG. 6 is a schematic configurational view illustrating an example of the process cartridge according to the present invention.

The process cartridge is detachably attachable to the main body of an electrophotographic image forming apparatus, and includes the developing apparatus according to one aspect of the present invention. An example of the process cartridge according to the present invention is illustrated in FIG. 6. The process cartridge illustrated in FIG. 6 includes a developing apparatus 9, a photosensitive member 5 and a cleaning apparatus 12, which are integrated into one. The process cartridge is detachably disposed in the main body of the electrophotographic image forming apparatus. Examples of the developing apparatus 9 include those identical to the image forming unit described below about the electrophotographic image forming apparatus. Besides the configuration above, the process cartridge according to the present invention may have a configuration in which the above-described members are integrated with a transfer member which transfers a developer image on a photosensitive member onto a recording material.

[Electrophotographic Image Forming Apparatus]

Figure 7:
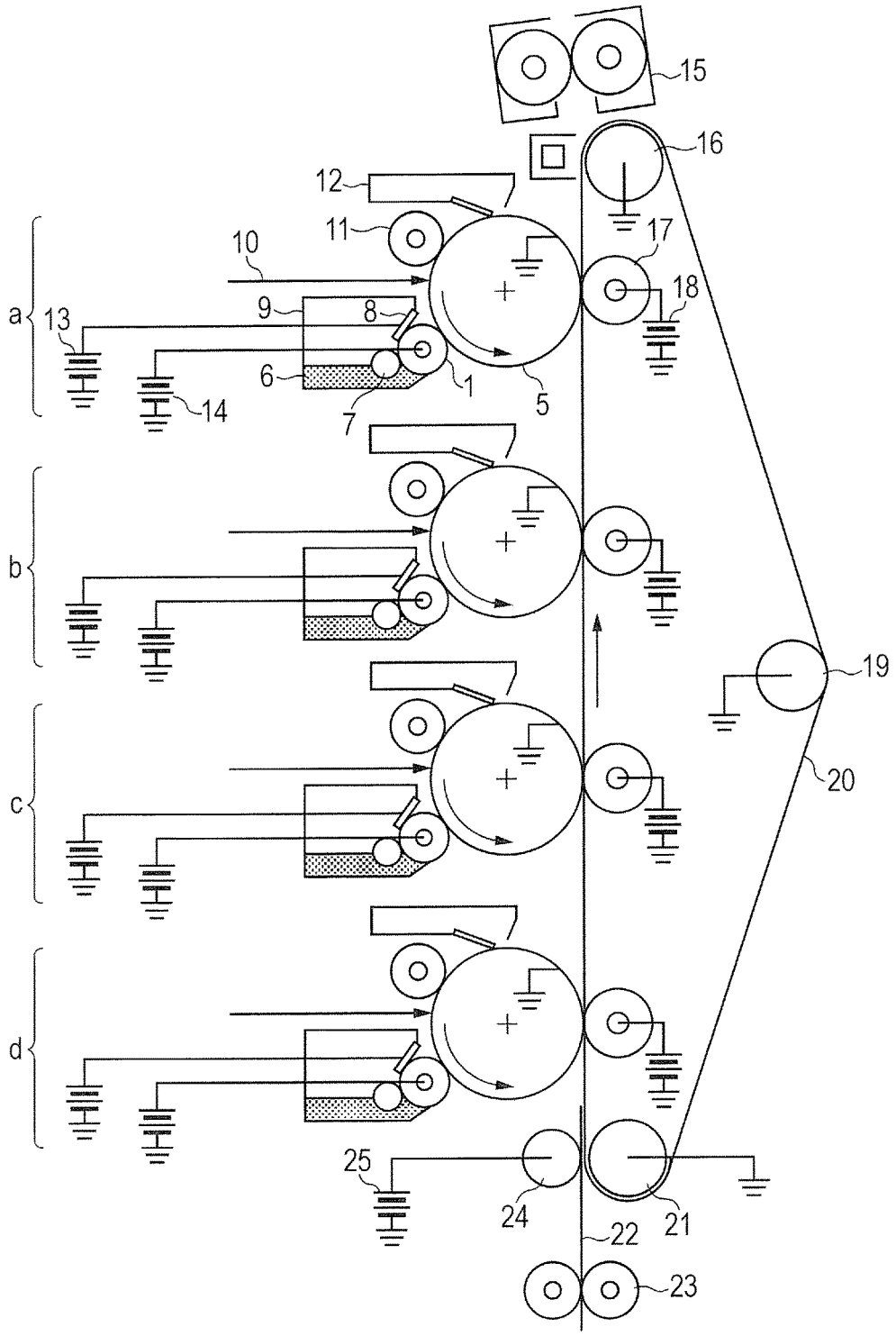
FIG. 7 is a schematic configurational view illustrating an example of the electrophotographic image forming apparatus according to the present invention.

The electrophotographic image forming apparatus includes the developing apparatus according to one aspect of the present invention. An example of the electrophotographic image forming apparatus according to the present invention is illustrated in FIG. 7. In FIG. 7, the electrophotographic image forming apparatus includes image forming units a to d disposed for a yellow toner (developer), a magenta toner (developer), a cyan toner (developer) and a black toner (developer), respectively. Each of the image forming units a to d includes a photosensitive member 5 as an electrostatic latent image carrier which rotates in the arrow direction. The electrophotographic image forming apparatus includes the following disposed around each of the photosensitive members 5: a charging apparatus 11 for uniformly charging the photosensitive member 5, an exposing unit (not illustrated) for irradiating the uniformly charged photosensitive member 5 with laser light 10 to form an electrostatic latent image, and a developing apparatus 9 for feeding a developer to the photosensitive member 5 having the electrostatic latent image thereon to develop the electrostatic latent image.

A transfer conveying belt 20 for transporting a recording material 22 fed by a feed roller 23, such as paper, is extended around a driving roller 16, a following roller 21 and a tension roller 19. The transfer conveying belt 20 is charged through an adsorption roller 24 from an adsorption bias power supply 25 to electrostatically attach the recording material 22 onto the surface of the transfer conveying belt for transportation of the recording material.

The image forming units a to d each include transfer bias power supplies 18, which apply charges for transferring the developer images on the photosensitive members 5 to the recording material 22 transported by the transfer conveying belt 20. The transfer bias is applied through transfer rollers 17 disposed on the rear surface of the transfer conveying belt 20. The developer images of the respective colors formed in the image forming units a to d are sequentially transferred to be superimposed on the recording material 22 transported by the transfer conveying belt 20 driven in synchronization with the image forming units a to d.

The color electrophotographic image forming apparatus further includes a fixing apparatus 15 for fixing the developer images transferred and superimposed on the recording material 22 by heating, and a conveying apparatus (not illustrated) for discharging the recording material 22 having the formed image to the outside of the color electrophotographic image forming apparatus. The image forming units each include a cleaning apparatus 12 having a cleaning blade for removing transfer residual developers not transferred and left on the photosensitive member 5 to clean the surface of the photosensitive member 5. The cleaned photosensitive members 5 are set to be in an image formable state and are in stand-by mode.

The image forming units include developing apparatuses 9. Each of the developing apparatuses 9 includes a developer container which accommodates a non-magnetic one-component developer as a developer, and a developer carrying roller 1 which is disposed so as to cover the opening of the developer container and has a portion exposed from the developer container and facing the photosensitive member.

The inside of the developer container includes a developer feed roller 7 for feeding the developer to the developer carrying roller 1 and scraping the residual developer not used and left on the developer carrying roller 1 after development at the same time, and a developer regulating member 8 for forming the developer on the developer carrying roller 1 into the form of a thin film and frictionally charging the developer at the same time. The developer feed roller 7 and the developer regulating member 8 are disposed in abutment with the developer carrying roller 1. The developer carrying roller 1 and the developer feed roller 7 rotate in the forward direction.

According to one aspect of the present invention, a developing apparatus can be provided which can sufficiently charge the developer, uniformly regulate the developer layer on the developer carrying roller to have a predetermined thickness, prevent scattering of the developer and spill of the developer in and out of the developer container, and reduce fogging images. According to another aspect of the present invention, a process cartridge and an electrophotographic image forming apparatus which can provide stable electrophotographic images can be provided.

EXAMPLES

The present invention will now be described by way of Examples and Comparative Examples.

Example 1

1. Preparation of Developer Regulating Member

A thermoplastic ester resin (TPEE) (manufactured by Du Pont-Toray Co., Ltd.; trade name: Hytrel 4047N) was used as a material for a blade member. A material for a supporting member used was stainless steel (SUS-304-1/2H material) in the form of a long sheet having a thickness of 0.08 mm and a width of 15 mm.

Figure 8:
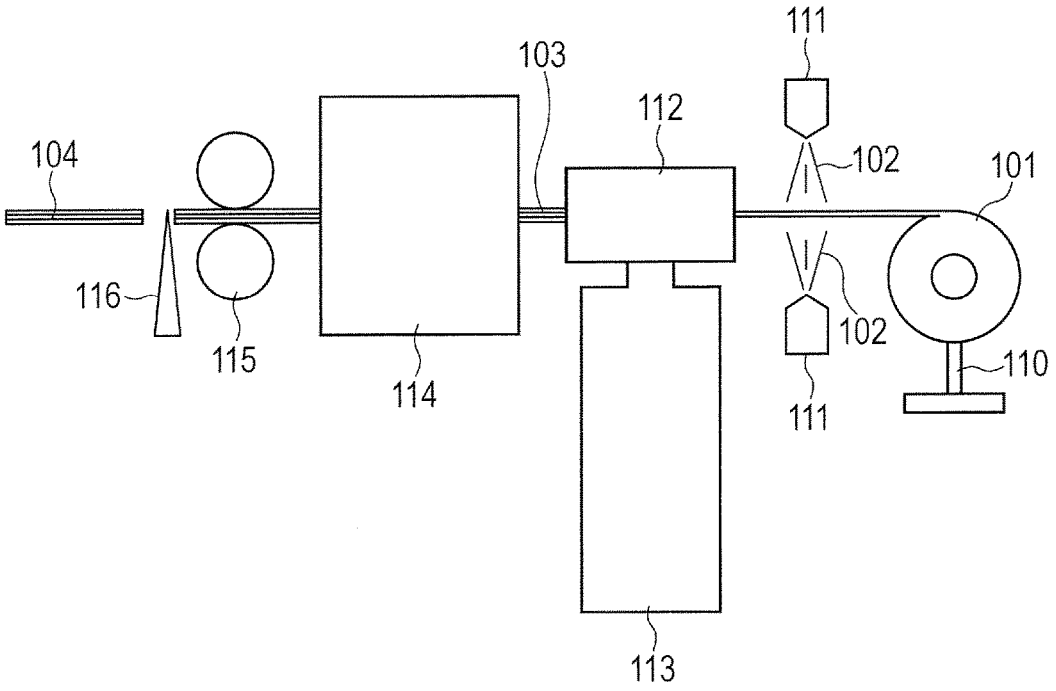
FIG. 8 is an example of an apparatus for manufacturing the developer regulating member.

FIG. 8 illustrates an apparatus for manufacturing a developer regulating member. The material for a blade member was first melted at 200° C. in an extrusion molding machine 113, and was injected into a molding cavity of a metal mold 112 for extrusion. At the same time, while a supporting member was traveling through the molding cavity of the metal mold for extrusion, one end surface of the supporting member in the lateral direction was coated with the material for a blade member. The temperature of the metal mold 112 was set at 250° C.

The blade member discharged from the metal mold 112 for extrusion was solidified by a cooler 114 to prepare a member including the supporting member having one end surface covered with the blade member. This member was cut to a length of 220 mm in the longitudinal direction by a cutter 116, and was welded to a surface treated steel sheet subjected to chromate conversion coating to prepare developer regulating member No. 1 processed to be attachable to a cartridge. As illustrated in FIG. 2, in a developer layer thickness regulating portion 31*a* of the developer regulating member, a surface facing the surface of a developer carrier may preferably have a concave arc shape such as, for example, an arc radius of 6.0 mm, and an arc length of 2.0 mm.

2. Preparation of Developer Carrying Roller

A substrate was provided, which included a stainless steel (SUS304) shaft core having an outer diameter of 6 mm and a length of 270 mm and a primer (trade name: DY35-051; manufactured by Dow Corning Toray Co., Ltd.) applied and burned thereto. The substrate was disposed in a metal mold. An addition-type silicone rubber composition prepared through mixing the materials shown in Table 1 below was injected into the cavity defined in the metal mold.

TABLE 1

| Materials | Parts by mass |
|---|---|
| Liquid silicone rubber material (trade name: SE6724A/B, manufactured by Dow Corning Toray Co., Ltd.) | 100 |
| Carbon black (trade name: TOKABLACK #7360SB, manufactured by Tokai Carbon Co., Ltd.) | 20 |
| Platinum catalyst | 0.1 |

Subsequently, the silicone rubber composition was cured through heating of the metal mold at a temperature of 150° C. for 15 minutes, and was removed from the metal mold. The product was further heated at a temperature of 180° C. for 1 hour to complete a curing reaction. A conductive elastic body including a substrate and a conductive elastic layer having a thickness of 3 mm and disposed on the outer periphery of the substrate was prepared. Next, the materials shown in Table 2 below were weighed, and 100 parts by mass of methyl ethyl ketone was added. These materials were dispersed with a bead mill to prepare a surface layer coating solution.

TABLE 2

| Materials | Parts by mass |
|---|---|
| Polyol (trade name: N5120, manufactured by Nippon Polyurethane Industry Co., Ltd.) | 87 |
| Isocyanate (trade name: L-55E, manufactured by Nippon Polyurethane Industry Co., Ltd.) | 13 |
| Carbon black (trade name: MA77, manufactured by Mitsubishi Chemical Corporation) | 20 |
| Acrylic particle (trade name: G-800 Transparent, manufactured by Negami Chemical Industrial Co., Ltd.) | 50 |

Subsequently, the conductive elastic body was immersed in the surface layer coating solution. The conductive elastic body was extracted from the coating solution, and was air dried for 60 minutes. Subsequently, the conductive elastic body was heated at a temperature of 160° C. for 5 hours to cure the coating solution to form a surface layer. Developer carrying roller No. 1 having a radius of 6.0 mm was thus prepared. The surface layer had a thickness of 10 μm.

3. Preparation of Developing Apparatus

Developer regulating member No. 1 and developer carrying roller No. 1 were attached to the developing apparatus illustrated in FIG. 1 to prepare a developing apparatus.

Figure 3A:
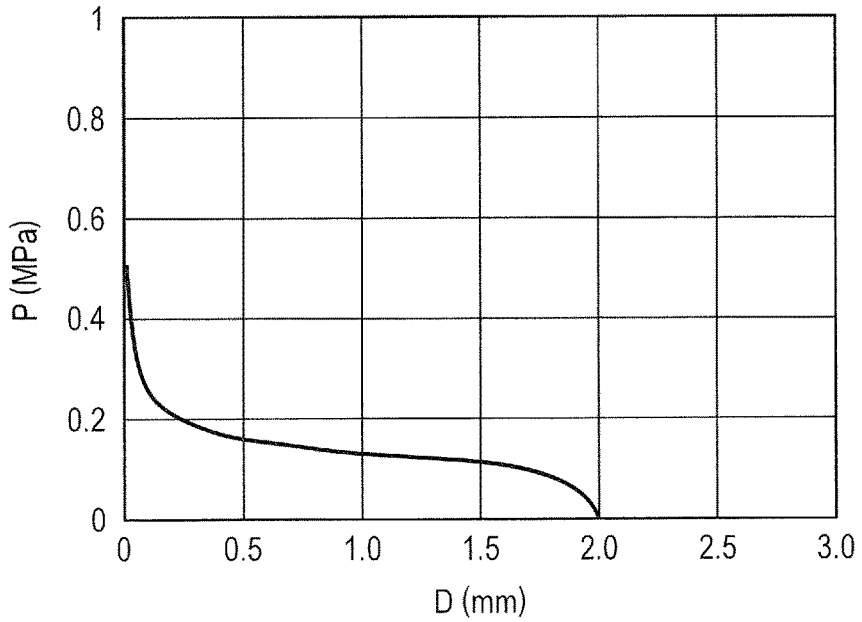
FIG. 3A is a chart of the distribution of an abutting pressure in Example 1.
Figure 3B:
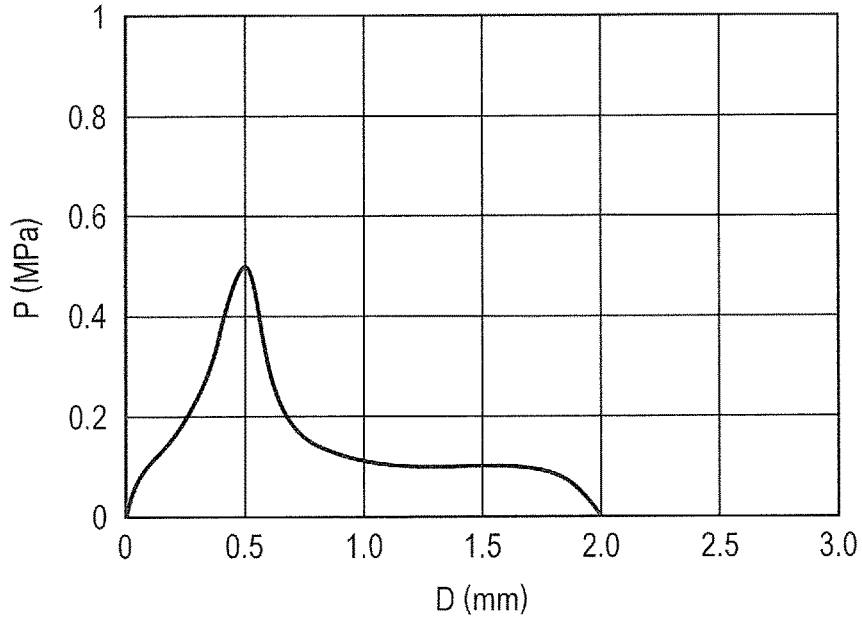
FIG. 3B is a chart of the distribution of an abutting pressure in Comparative Example 3.

4. Measurement of Abutting Width of Developer Layer Thickness Regulating Portion and Distribution of Abutting Pressure As illustrated in FIG. 4A, the developer regulating member was tilted in the state that the distal end of the developer regulating member was closer to the surface of the developer carrying roller, and was pressed against the surface of the developer carrying roller for abutment such that the abutting portion had a maximum value of the abutting pressure of 0.5 MPa, the maximum value was present at the upstream edge of the abutting portion, and the abutting pressure was 0.15 to 0.1 MPa in the region from the upstream edge to 30 to 90% of the abutting width W. The abutting width and the distribution of the abutting pressure were measured and evaluated. The distribution of the abutting pressure is illustrated in FIG. 3A. In FIGS. 3A and 3B, the ordinate indicates an abutting pressure P (MPa), and the abscissa indicates a position D (mm) in the transverse direction of the abutting portion with the position of the upstream edge of the abutting portion being 0 mm.

The abutting width W and the distribution of the abutting pressure were measured by the following methods. In FIG. 1, a pressure measurement film (trade name "PRESCALE"; manufactured by FUJIFILM Corporation; for extreme low pressure (4LW)) was sandwiched between the developer regulating member 8 and the developer carrying roller 1, and the abutting width W was determined from a region turned into a red color in the pressure measurement film. The distribution of the abutting pressure was determined from the degree of the red color in the pressure measurement film. The relationship between the abutting pressure and the type of "PRESCALE" are shown in Table 3 below.

A film A to which a color fixer was applied, of "PRESCALE" was cut to a length of 50 to 70 mm and a width of 10 to 20 mm, and was fixed to the outer peripheral surface of the developer carrying roller on which the developer regulating member abutted. Subsequently, a film C to which a developer was applied, of "PRESCALE" was cut to a length of 50 to 70 mm and a width of 10 to 20 mm, and was fixed to the developer layer thickness regulating portion of the developer regulating member. The developer regulating member having the film C of "PRESCALE" fixed thereto was brought into abutment with the developer carrying roller having the film A of "PRESCALE" fixed thereto, and was left for 1 hour. Then, the film A of "PRESCALE" was peeled from the developer regulating member to evaluate the degree of the red color. In the measurement using two or more PRESCALEs in combination such as "PRESCALE" for extreme low pressure (4LW) and "PRESCALE" for ultra super low pressure (LLLW), these PRESCALEs were sequentially replaced starting from "PRESCALE" for measuring low abutting pressure to one for measuring higher abutting pressure. The evaluation can be performed visually using a standard chart for "PRESCALE", or by analysis with a pressure image analysis system (trade name: FPD-8010J; manufactured by FUJIFILM Corporation).

TABLE 3

| Abutting pressure | Type of PRESCALE |
|---|---|
| 0.05-0.2 MPa | "PRESCALE" (manufactured by FUJIFILM Corporation; For extreme low pressure (4LW)) |
| 0.2-0.6 MPa | "PRESCALE" (manufactured by FUJIFILM Corporation; For ultra super low pressure (LLLW)) |
| 0.6-2.5 MPa | "PRESCALE" (manufactured by FUJIFILM Corporation; For super low pressure (LLW)) |

5. Evaluation of Images Formed by Image Forming Apparatus

The developing apparatus was incorporated into a process cartridge for an electrophotographic image forming apparatus (trade name: CLJ CP4525; manufactured by Hewlett-Packard Company) to evaluate images as follows.

[Determination of Fogging]

A black developer (100 g) was filled into the developer container of the developing apparatus. In the next step, the process cartridge was incorporated into the electrophotographic image forming apparatus, and was left under a low temperature and low humidity environment at a temperature of 15° C. and a relative humidity of 10% for 24 hours. Subsequently, continuous output of an image having a coverage rate of 2% was repeated. One sheet of a solid white image was output every time after 999 sheets were continuously output. This operation was repeated until the total number of outputs reached 10000 sheets. The fogging value was measured 10 times by the following method. The fogging value was determined as follows: the reflection density $R_1$ of a recording material before formation of the image and the reflection density $R_2$ of the recording material onto which the solid white image was output were measured using a reflection densitometer (trade name: TC-6 DS/A; manufactured by Tokyo Denshoku Co., Ltd.). An increase "$R_2-R_1$" in reflection density was defined as the fogging value. The reflection density was measured at five points in total in the image printing region of the recording material, i.e., the upper left end, the upper right end, the lower left end, the lower right end (these were each located 2 cm from the boundaries of the image printing region) and the central point. In the recording material before formation of the image, the arithmetic average of the measured values of the five points was defined as the reflection density $R_1$. In the recording material having the solid white image output thereonto, the maximum value of the measured values of the five points was defined as the reflection density $r_2$. $R_2$ was calculated as the arithmetic average of these ten $r_2$'s thus obtained. The fogging value was then calculated, and was evaluated according to the following criteria:

Rank A: The fogging value is less than 1.0.

Rank B: The fogging value is 1.0 or more and less than 3.0.

Rank C: The fogging value is 3.0 or more and less than 5.0.

Rank D: The fogging value is 5.0 or more.

Usually, no developer is transferred onto the transfer paper having the solid white image formed thereon, and the fogging value is less than 3.0. However, if the charge quantity of the developer is insufficient, the developer moves onto the photosensitive member even during the formation of the solid white image, and then is transferred onto the transfer paper to cause fogging.

Examples 2 and 3

Developing apparatuses were prepared in the same manner as in Example 1 except that the length of the arc of the developer layer thickness regulating portion was varied as shown in Table 5. These developing apparatuses were measured and evaluated in the same manner as in Example 1.

Examples 4 to 7, 14, and 15

Developing apparatuses were prepared in the same manner as in Example 1 except that the maximum value of the abutting pressure and the abutting pressure in the region from the upstream edge to 30 to 90% of the abutting width W were varied as shown in Table 5. These developing apparatuses were measured and evaluated in the same manner as in Example 1.

Example 8

The center of the arc of the developer thickness regulating portion was deviated from the center of the outer diameter of the developer carrying roller to press the distal end of the developer regulating member against the surface of the developer carrying roller for abutment such that the abutting pressure had a maximum value of 0.5 MPa at the upstream edge of the abutting portion width W, and the abutting pressure was 0.16 to 0.1 MPa in the region from the upstream edge to 30 to 90% of the abutting width W. Except for these, the developing apparatus was prepared, measured and evaluated in the same manner as in Example 1.

Example 9

The molding cavity of a metal mold for extrusion was processed into a predetermined shape to prepare developer regulating member No. 9 including a developer layer thickness regulating portion whose surface had two concave arcs. In other words, an arc having a radius of 5.0 mm and a length of 0.6 mm was formed on the surface of the distal end of the developer layer thickness regulating portion of the developer regulating member, and another arc having a radius of 6.0 mm and a length of 1.4 mm was formed on the surface of the proximal end thereof.

The distal end of the developer regulating member was pressed against the surface of the developer carrying roller for abutment such that the abutting pressure had a maximum value of 0.5 MPa at the upstream edge of the abutting portion width W, and the abutting pressure was 0.15 to 0.1 MPa in the region from the upstream edge to 30 to 90% of the abutting width W. Except for these, the developing apparatus was prepared, measured and evaluated in the same manner as in Example 1.

Example 10

The molding cavity of a metal mold for extrusion was processed into a predetermined shape to prepare developer regulating member No. 10 including a developer layer thickness regulating portion whose surface had a projection. In other words, a projection having a height of 0.1 mm and a length of 0.4 mm was formed on the surface including the distal end of the developer layer thickness regulating portion of the developer regulating member, and a concave arc having a radius of 6.0 mm and a length of 1.8 mm was formed on the surface of the proximal end thereof.

The developer regulating member was pressed against the surface of the developer carrying roller in the manner that the distal end of the developer regulating member was brought closer to the surface of the developer carrying roller for abutment such that the abutting width W was 2.0 mm, the abutting pressure had a maximum value of 0.5 MPa at the upstream edge of the abutting portion width W, and the abutting pressure was 0.16 to 1.0 MPa in the region from the upstream edge to 30 to 90% of the abutting width W. Except for these, the developing apparatus was prepared, measured and evaluated in the same manner as in Example 1.

Example 11

A thermoplastic urethane resin (trade name: Miractran XN-2001; manufactured by Tosoh Corporation) was used as a material for a blade member to prepare developer regulating member No. 11. Except for this, the developing apparatus was prepared, measured and evaluated in the same manner as in Example 1.

Example 12

A developer regulating member was pressed against the surface of a developer carrying roller in the manner that the distal end of the developer regulating member was brought closer to the surface of the developer carrying roller at a tilt angle smaller than that of Example 1 for abutment such that the abutting pressure had a maximum value of 0.5 MPa at a position in the region from the upstream edge to 10% of the abutting width W, and the abutting pressure was 0.16 to 0.1 MPa in the region from the upstream edge to 30 to 90% of the abutting width W. Except for these, the developing apparatus was prepared, measured and evaluated in the same manner as in Example 1.

Example 13

A developer regulating member was pressed against the surface of a developer carrying roller in the manner that the distal end of the developer regulating member was brought closer to the surface of the developer carrying roller at a tilt angle smaller than that of Example 4 for abutment such that the abutting pressure had a maximum value of 0.5 MPa at a position in the region from the upstream edge to 20% of the abutting width W, and the abutting pressure was 0.17 to 0.1 MPa in the region from the upstream edge to 30 to 90% of the abutting width W. Except for these, the developing apparatus was prepared, measured and evaluated in the same manner as in Example 1.

Example 16

Figure 9A:
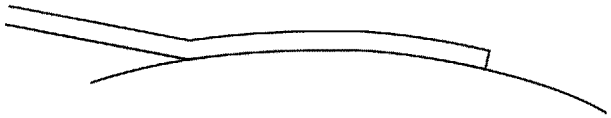
FIGS. 9A and 9B are other schematic sectional views illustrating an example of the developer regulating member according to the present invention.

This Example is an example using a developer regulating member illustrated in FIG. 9A in which a supporting member and a blade member were formed of the same material.

1. Preparation of Developer Regulating Member

A material for a developer regulating member used was stainless steel (SUS-304-1/2H material) in the form of a long sheet having a thickness of 0.08 mm and a width of 15 mm. The long sheet was cut to a length of 220 mm in the longitudinal direction, and was pressed to a developer layer thickness regulating portion having a surface having a concave arc shape. The surface was processed to have an arc radius of 6.0 mm and an arc length of 2.0 mm. Subsequently, the workpiece was welded to a surface treated steel sheet subjected to chromate conversion coating to prepare developer regulating member No. 16 (FIG. 9A).

2. Preparation and Evaluation of Developing Apparatus

A developing apparatus was prepared in the same manner as in Example 1 except that the developer regulating member was used. In the next step, the developer regulating member was tilted in the state where the distal end of the developer regulating member was closer to the surface of the developer carrying roller, and was pressed against the surface of the developer carrying roller for abutment such that the abutting pressure had a maximum value of 0.5 MPa at the upstream edge of the abutting portion, and the abutting pressure was 0.15 to 0.1 MPa in the region from the upstream edge to 30 to 90% of the abutting width W. Except for these, the developing apparatus was prepared, measured and evaluated in the same manner as in Example 1.

Example 17

Figure 9B:
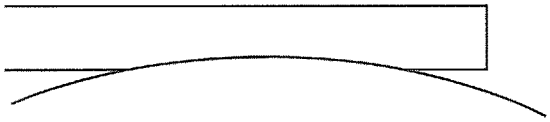

This Example is an example using a developer regulating member illustrated in FIG. 9B in which the supporting member and the blade member were formed of the same material.

1. Preparation of Developer Regulating Member

The two materials shown in Component (1) of Table 4 below were reacted at a temperature of 80° C. for 3 hours under stirring to prepare a prepolymer (NCO %: 8.50%). The prepolymer was mixed with the five materials shown in Component (2) of Table 4 to prepare a polyurethane elastomer raw material composition. The composition was injected into the cavity of a molding metal mold (split mold), and was cured at a temperature of 130° C. over 2 minutes. The product was removed from the metal mold to obtain a developer regulating member. The cavity of the molding metal mold (split mold) can provide a developer layer thickness regulating portion of the developer regulating member having an arc shape relative to the surface of the developer carrying roller and having an arc radius of 6.0 mm and an arc length of 2.0 mm. The resulting developer regulating member was molded into 220 mm in the longitudinal direction, 15 mm in the lateral direction, and a thickness of 2.0 mm, and was fixed to a surface treated steel sheet subjected to chromate conversion coating using a hot-melt adhesive to prepare developer regulating member No. 17.

TABLE 4

| | Abbreviations | Materials | Amount used g |
|---|---|---|---|
| Component (1) | MDI | 4,4'-Diphenylmethane diisocyanate (trade name; Millionate MT, manufactured by Tosoh Corporation) | 326.3 |
| | PBA | Polybutylene adipate polyester polyol having number average molecular weight of 2500 | 673.7 |
| Component (2) | PHA | Polyhexylene adipate polyester polyol having number average molecular weight of 1000 | 150.8 |
| | 14BD | 1,4-Butanediol | 26.2 |
| | TMP | Trimethylolpropane | 21.4 |
| | Catalyst A | Polycat46 (trade name, manufactured by Air Products Japan K.K.) | 0.07 |
| | Catalyst B | N,N-Dimethylaminohexanol (trade name; KAOLIZER No. 25, manufactured by Kao Corporation) | 0.28 |

2. Preparation and Evaluation of Developing Apparatus

A developing apparatus was prepared in the same manner as in Example 1 except that the developer regulating member was used. In the next step, the developer regulating member was tilted in the state where the distal end of the developer regulating member was closer to the surface of the developer carrying roller, and was pressed against the surface of the developer carrying roller for abutment such that the abutting pressure had a maximum value of 0.5 MPa at the upstream edge of the abutting portion, and the abutting pressure was 0.15 to 0.1 MPa in the region from the upstream edge to 30 to 90% of the abutting width W. Except for these, the developing apparatus was prepared, measured and evaluated in the same manner as in Example 1.

The materials of the blade members, the respective measured values, and the results of evaluation in the Examples are shown in Table 5.

Comparative Examples 1, 2, 4 and 5

In each of the Comparative Examples, the molding cavity of a metal mold for extrusion was processed into a predetermined shape. A developer layer thickness regulating portion of a developer regulating member was molded such that the surface facing the surface of the developer carrying roller had a concave arc shape, and had an arc radius of 6.0 mm and an arc length of 0.8 mm, 5.2 mm or 2.0 mm. Except for this, a developing apparatus was prepared in the same manner as in Example 1.

The developer regulating member was tilted in the state where the distal end of the developer regulating member was closer to the surface of the developer carrying roller, and was pressed against the surface of the developer carrying roller. The maximum value of the abutting pressure and the abutting pressure in the region from the upstream edge to 30 to 90% of the abutting width W were varied as shown in Table 6. Except for these, developing apparatuses were prepared, measured and evaluated in the same manner as in Example 1.

Comparative Example 3

The molding cavity of a metal mold for extrusion was processed into a predetermined shape. A developer layer thickness regulating portion of a developer regulating member was molded such that the surface facing the surface of the developer carrying roller had a concave arc shape, and had an arc radius of 6.5 mm and an arc length of 2.0 mm. Except for this, a developing apparatus was prepared in the same manner as in Example 1.

The developer regulating member was tilted in the state where the distal end of the developer regulating member was closer to the surface of the developer carrying roller, and was pressed against the surface of the developer carrying roller for abutment such that the abutting pressure had a maximum value of 0.7 MPa in the region from the upstream edge to 25% of the abutting width W, and the abutting pressure was 0.25 to 0.10 MPa in the region from the upstream edge to 30 to 90% of the abutting width W. The distribution of the abutting pressure is illustrated in FIG. 3B. Except for these, a developing apparatus was prepared, measured and evaluated in the same manner as in Example 1.

The materials of the blade members, the respective measured values, and the results of evaluation in the Comparative Examples are shown in Table 6.

TABLE 5

| | | Example | | | | | | | | |
|---|---|---|---|---|---|---|---|---|---|---|
| | | 1 | 2 | 3 | 4 | 5 | 6 | 7 | 8 | 9 |
| Materials for blade member | | TPEE | TPEE | TPEE | TPEE | TPEE | TPEE | TPEE | TPEE | TPEE |
| Arc radius | (mm) | 6.0 | 6.0 | 6.0 | 6.0 | 6.0 | 6.0 | 6.0 | 6.0 | ** |
| Arc length | (mm) | 2.0 | 1.0 | 5.0 | 2.0 | 2.0 | 2.0 | 2.0 | 2.0 | ** |
| Width of abutting portion W | (mm) | 2.0 | 1.0 | 5.0 | 2.0 | 2.0 | 2.0 | 1.8 | 1.7 | 2.0 |
| Position of maximum value of abutting pressure | Distance from upstream edge (mm) | 0 | 0 | 0 | 0 | 0 | 0 | 0 | 0 | 0 |
| | Distance from upstream edge relative to width W of abutting portion (%) | 0 | 0 | 0 | 0 | 0 | 0 | 0 | 0 | 0 |
| Abutting pressure in region of 30 to 90% of width W of abutting portion | (MPa) | 0.15~0.10 | 0.15~0.10 | 0.15~0.10 | 0.10~0.08 | 0.18~0.12 | 0.13~0.10 | 0.17~0.10 | 0.16~0.10 | 0.15~0.10 |
| Maximum abutting pressure | (MPa) | 0.50 | 0.50 | 0.50 | 0.60 | 0.40 | 0.20 | 1.00 | 0.50 | 0.50 |
| Evaluation | Rank | A | A | A | A | A | A | A | A | A |

| | | Example | | | | | | | |
|---|---|---|---|---|---|---|---|---|---|
| | | 10 | 11 | 12 | 13 | 14 | 15 | 16 | 17 |
| Materials for blade member | | TPEE | Thermo-plastic poly-urethane | TPEE | TPEE | TPEE | TPEE | SUS | Thermo-setting poly-urethane |
| Arc radius | (mm) | 6* | 6.0 | 6.0 | 6.0 | 6.0 | 6.0 | 6.0 | 6.0 |
| Arc length | (mm) | 1.8* | 2.0 | 2.0 | 2.0 | 2.0 | 2.0 | 2.0 | 2.0 |
| Width of abutting portion W | (mm) | 1.8 | 2.0 | 2.0 | 2.0 | 2.0 | 1.7 | 2.0 | 2.0 |

TABLE 5-continued

| | | | | | | | | | |
|---|---|---|---|---|---|---|---|---|---|
| Position of maximum value of abutting pressure | Distance from upstream edge (mm) | 0 | 0 | 0.2 | 0.4 | 0 | 0 | 0 | 0 |
| | Distance from upstream edge relative to width W of abutting portion (%) | 0 | 0 | 10 | 20 | 0 | 0 | 0 | 0 |
| Abutting pressure in region of 30 to 90% of width W of abutting portion | (MPa) | 0.16~0.10 | 0.15~0.10 | 0.16~0.10 | 0.17~0.10 | 0.12~0.10 | 0.17~0.10 | 0.15~0.10 | 0.15~0.10 |
| Maximum abutting pressure | (MPa) | 0.50 | 0.50 | 0.50 | 0.50 | 0.18 | 1.20 | 0.50 | 0.50 |
| Evaluation | Rank | A | A | B | B | B | B | A | A |

**Two arcs

*Projection in upstream portion

TABLE 6

| | | Comparative Example | | | | |
|---|---|---|---|---|---|---|
| | | 1 | 2 | 3 | 4 | 5 |
| Materials for blade member | | TPEE | TPEE | TPEE | TPEE | TPEE |
| Arc radius | (mm) | 6.0 | 6.0 | 6.5 | 6.0 | 6.0 |
| Arc length | (mm) | 0.8 | 5.2 | 2.0 | 2.0 | 2.0 |
| Width of abutting portion W | (mm) | 0.8 | 5.2 | 2.0 | 2.0 | 2.0 |
| Position of maximum value of abutting pressure | Distance from upstream edge (mm) | 0.0 | 0.0 | 0.5 | 0.0 | 0.0 |
| | Distance from upstream edge relative to width W of abutting portion (%) | 0 | 0 | 25 | 0 | 0 |
| Abutting pressure in region of 30 to 90% of width W of abutting portion | (MPa) | 0.17~0.09 | 0.15~0.10 | 0.25~0.10 | 0.05~0.04 | 0.20~0.15 |
| Maximum abutting pressure | (MPa) | 0.5 | 0.5 | 0.7 | 0.7 | 0.3 |
| Evaluation | Rank | C | D | D | C | D |

As described above, fogging images can be reduced by the developing apparatus according to the present invention wherein in the abutting portion between the developer carrying roller and the developer regulating member, the abutting width W from the upstream edge to the downstream edge of the developer carrying roller in the rotational direction thereof is 1.0 mm or more and 5.0 mm or less, and the abutting pressure of the abutting portion has a maximum value in a region from the upstream edge to 20% or less of the abutting width W, and is 0.08 MPa or more and 0.18 MPa or less in the region from the upstream edge to 30 to 90% of the abutting width W.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-150120, filed Jul. 29, 2016, which is hereby incorporated by reference herein in its entirety.

What is claimed is:

1. A developing apparatus comprising:

a developer carrying roller rotatable in a first rotating direction, and a developer regulating member which regulates a thickness of a developer layer carried on the developer carrying roller, wherein at least a part of the developer regulating member is in pressure contact with a surface of the developer carrying roller to form an abutting portion between the developer carrying roller and the developer regulating member, the abutting portion having an abutting width W in a circumferential direction of the developer carrying member of 1.0 mm or more and 5.0 mm or less, wherein in the abutting portion, an abutting pressure has a maximum value in a first area, the first area having a width of 20% or less of the abutting width W from an upstream edge of the abutting portion in the first rotating direction, and wherein an abutting pressure in a second area is 0.08 MPa or more and 0.18 MPa or less, the second area starting at a point in a downstream side in the first rotating direction from the upstream edge of the abutting portion by 30% of the abutting width W, and ending at a point in a downstream side in the first rotating direction from the upstream edge of the abutting portion by 90% of the abutting width W.

2. The developing apparatus according to claim 1, wherein the abutting portion of the developer regulating member has a concave curved surface at a side facing a surface of the developer carrying roller.

3. The developing apparatus according to claim 1, wherein the abutting pressure has the maximum value at the upstream edge of the abutting portion.

4. The developing apparatus according to claim 1, wherein the abutting pressure has the maximum value of 0.2 MPa or more and 1.0 MPa or less.

5. The developing apparatus according to claim 1, wherein the developer regulating member comprises at least a supporting member and a blade member, and the blade member comprises an elastic member.

6. The developing apparatus according to claim 5, wherein the elastic member comprises a thermoplastic elastomer.

7. A process cartridge detachably attachable to a main body of an electrophotographic image forming apparatus, and comprising a developing apparatus, the developing apparatus comprising:

a developer carrying roller rotatable in a first rotating direction, and a developer regulating member which regulates a thickness of a developer layer carried on the developer carrying roller, wherein at least a part of the developer regulating member is in pressure contact with a surface of the developer carrying roller to form an abutting portion between the developer carrying roller and the developer regulating member, the abutting portion having an abutting width W in a circumferential direction of the developer carrying member of 1.0 mm or more and 5.0 mm or less, wherein in the abutting portion, an abutting pressure has a maximum value in a first area, the first area having a width of 20% or less of the abutting width W from an upstream edge of the abutting portion in the first rotating direction, and wherein an abutting pressure in a second area is 0.08 MPa or more and 0.18 MPa or less, the second area starting at a point in a downstream side in the first rotating direction from the upstream edge of the abutting portion by 30% of the abutting width W, and ending at a point in a downstream side in the first rotating direction from the upstream edge of the abutting portion by 90% of the abutting width W.

8. An electrophotographic image forming apparatus comprising a developing apparatus, wherein the developing apparatus comprises a developer carrying roller rotatable in a first rotating direction, and a developer regulating member which regulates a thickness of a developer layer carried on the developer carrying roller, wherein at least a part of the developer regulating member is in pressure contact with a surface of the developer carrying roller to form an abutting portion between the developer carrying roller and the developer regulating member, the abutting portion having an abutting width W in a circumferential direction of the developer carrying member of 1.0 mm or more and 5.0 mm or less, wherein in the abutting portion, an abutting pressure has a maximum value in a first area, the first area having a width of 20% or less of the abutting width W from an upstream edge of the abutting portion in the first rotating direction, and wherein an abutting pressure in a second area is 0.08 MPa or more and 0.18 MPa or less, the second area starting at a point in a downstream side in the first rotating direction from the upstream edge of the abutting portion by 30% of the abutting width W, and ending at a point in a downstream side in the first rotating direction from the upstream edge of the abutting portion by 90% of the abutting width W.

* * * * *